US010457056B2

(12) United States Patent
Toya

(10) Patent No.: US 10,457,056 B2
(45) Date of Patent: Oct. 29, 2019

(54) LIQUID EJECTING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/901,696

(22) Filed: Feb. 21, 2018

(65) Prior Publication Data

US 2018/0244051 A1 Aug. 30, 2018

(30) Foreign Application Priority Data

Feb. 24, 2017 (JP) ..... 2017-033038

(51) Int. Cl.
*B41J 2/175* (2006.01)

(52) U.S. Cl.
CPC ..... *B41J 2/1752* (2013.01); *B41J 2/1753* (2013.01); *B41J 2/17509* (2013.01); *B41J 2/17523* (2013.01); *B41J 2/17526* (2013.01); *B41J 2/17553* (2013.01)

(58) Field of Classification Search
CPC .... B41J 2/1752; B41J 2/17509; B41J 2/1753; B41J 2/17523; B41J 2/17553; B41J 2/17526
See application file for complete search history.

(56) References Cited

U.S. PATENT DOCUMENTS 5,737,541 A 4/1998 Shimizu et al.
2008/0106575 A1* 5/2008 Shimizu ..... B41J 2/17509 347/49

FOREIGN PATENT DOCUMENTS

JP 07-319584 A 12/1995
JP 2008-110577 A 5/2008
JP 3183798 U 5/2013

OTHER PUBLICATIONS

IP.com search (Year: 2018).*
IP.com search (Year: 2019).*

* cited by examiner

*Primary Examiner* — Lisa Solomon
(74) *Attorney, Agent, or Firm* — Workman Nydegger

(57) ABSTRACT

A liquid ejecting apparatus includes a mounting portion on which a liquid container capable of accommodating liquid is mounted in a detachable manner, and a liquid ejecting head configured to eject the liquid which is supplied from the liquid container. The mounting portion has a locking portion capable of locking the liquid container, a movement path extending toward the locking portion, and a first pressing portion and a second pressing portion capable of pressing the liquid container in a direction in which the liquid container is away from the locking portion. The second pressing portion presses the liquid container on the movement path on which the liquid container is away from the locking portion, and the second pressing portion and the first pressing portion press the liquid container when the liquid container is locked by the locking portion.

10 Claims, 7 Drawing Sheets

LIQUID EJECTING APPARATUS

BACKGROUND

1. Technical Field

The present invention relates to a liquid ejecting apparatus such as a printer.

2. Related Art

As an example of a liquid ejecting apparatus, there is a printer in which a lock lever and a coil spring are provided on a cartridge mounting portion and the lock lever locks an ink cartridge when the ink cartridge is inserted into the cartridge mounting portion against pressing force of the coil spring (for example, Japanese Utility Model Registration No. 3183798).

When locking by the lock lever is released, the ink cartridge is pushed out of the cartridge mounting portion with the pressing force of the coil spring. In this case, when the pressing force of the coil spring is made stronger, the cartridge is taken out easily but resistance when the cartridge is inserted is increased and it is difficult to mount the cartridge.

SUMMARY

An advantage of some aspects of the invention is to provide a liquid ejecting apparatus capable of appropriately attaching and detaching a liquid container.

A liquid ejecting apparatus according to an aspect of the invention includes a mounting portion on which a liquid container capable of accommodating liquid is mounted in a detachable manner, and a liquid ejecting head configured to eject the liquid which is supplied from the liquid container, wherein the mounting portion has a locking portion capable of locking the liquid container, a movement path extending toward the locking portion, and a first pressing portion and a second pressing portion capable of pressing the liquid container in a direction in which the liquid container is away from the locking portion, the second pressing portion presses the liquid container on the movement path on which the liquid container is away from the locking portion, and the second pressing portion and the first pressing portion press the liquid container when the liquid container is locked by the locking portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. The liquid ejecting apparatus is, for example, an ink jet printer that performs printing on a medium such as paper by ejection of ink as an example of liquid.

Figure 1:
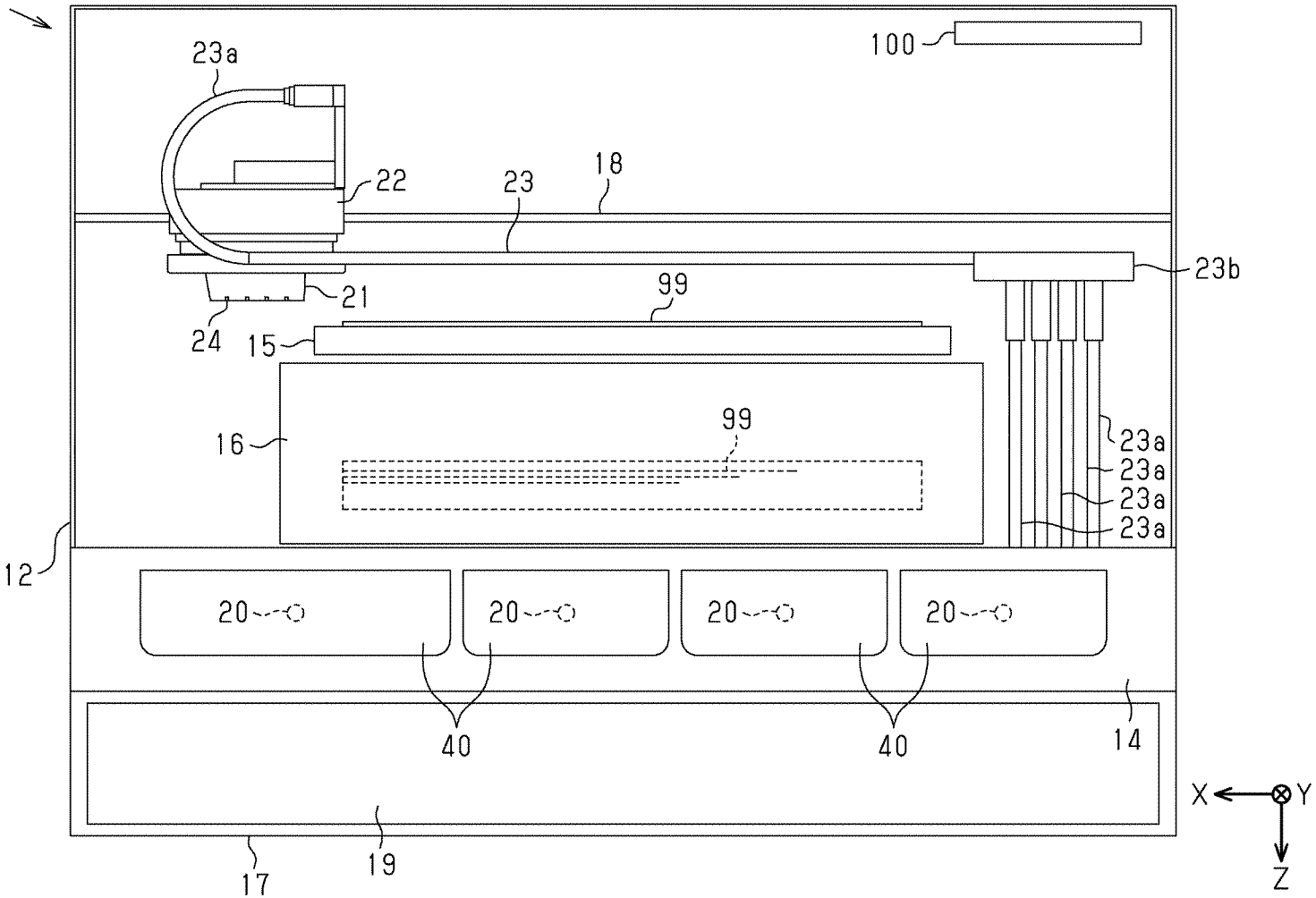
FIG. 1 is an overall configuration view of an embodiment of a liquid ejecting apparatus.

As illustrated in FIG. 1, a liquid ejecting apparatus 11 includes a housing 12, a mounting portion 14 on which liquid accommodation bodies 40 are mounted in a detachable manner, a cassette 16 capable of accommodating media 99, and a support table 15 capable of supporting the medium 99 thereon, and a controller 100. The liquid accommodation bodies 40 accommodate therein liquid. The cassette 16 is mounted on the housing 12 in a detachable manner. One or a plurality of extension units 17 can be arranged at positions aligned with the housing 12 in a gravity direction Z. A cassette 19 capable of accommodating therein the media 99 is mounted on the extension unit 17.

The housing 12 accommodates therein a liquid ejecting head 21, a carriage 22 holding the liquid ejecting head 21 and reciprocating in a width direction X, a guide shaft 18 guiding movement of the carriage 22, and supply flow paths 23 arranged so as to supply the liquid to the liquid ejecting head 21. Liquid inlet portions 20 configure upstream ends of the supply flow paths 23. The supply flow paths 23 include tubes 23*a* that can be deformed and deflected, and joints 23*b* having higher rigidity than the tubes.

The mounting portion 14 has the liquid inlet portions 20 capable of introducing the liquid. When each liquid container 40 is mounted on the mounting portion 14, the liquid accommodated in the liquid container 40 is introduced into the supply flow path 23 after passing through the liquid inlet portion 20. The liquid is thus supplied to the liquid ejecting head 21 from the liquid container 40.

One or the plurality of liquid accommodation bodies 40 are mounted on the mounting portion 14 in a detachable manner. The liquid container 40 is mounted on the mounting portion 14 with movement in a depth direction Y and is detached from the mounting portion 14 with movement in a takeout direction as an opposite direction to the depth direction Y. When the plurality of liquid accommodation bodies 40 are mounted on the mounting portion 14, the plurality of liquid accommodation bodies 40 are preferably mounted while being aligned in the width direction X.

The liquid ejecting head 21 has nozzles 24 capable of ejecting the liquid and is moved together with the carriage 22. The liquid ejecting head 21 is configured to eject the liquid toward the medium 99 supported on the support table 15 while being moved. The controller 100 controls components of the liquid ejecting apparatus 11, such as the liquid ejecting head 21.

Figure 2:
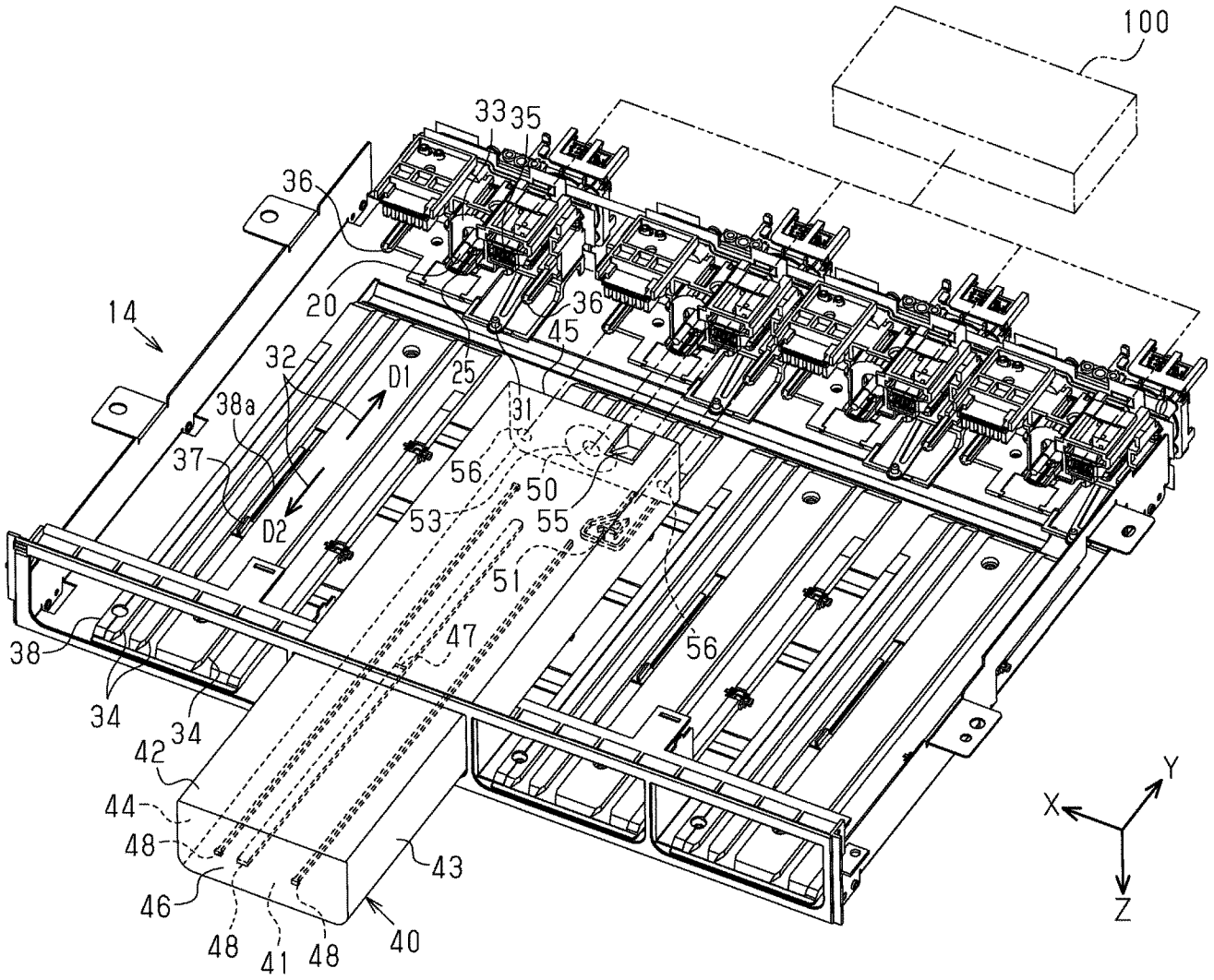
FIG. 2 is a perspective view of a mounting portion and a liquid container included in the liquid ejecting apparatus in FIG. 1.

As illustrated in FIG. 2, the mounting portion 14 has locking portions 31, movement paths 32, and first pressing portions 33 and second pressing portions 37. The locking portions 31 are capable of locking the liquid accommodation bodies 40. The movement paths 32 extend toward the locking portions 31. The first pressing portions 33 and second pressing portions 37 are capable of pressing the liquid accommodation bodies 40 in the directions in which the liquid accommodation bodies 40 are away from the locking portions 31. The ends of the movement paths 32 at the near side in the depth direction Y are assumed to starting ends and the ends thereof at the back side in the depth direction Y are assumed to terminating ends. On the movement paths 32, the direction toward the locking portions 31 is indicated as a mounting direction D1 and the direction away from the locking portions 31 is indicated as a takeout direction D2. The first pressing portions 33 are arranged at the terminating ends of the movement paths 32 and the second pressing portions 37 are arranged on halfway of the movement paths 32.

The mounting portion 14 may have substrate connection portions 35 which are electrically connected to the controller 100 and positioning projections 36 which are arranged so as to be aligned with the substrate connection portions 35. It is preferable that the substrate connection portions 35 be arranged at the upper side relative to the liquid inlet portions 20. Liquid receiving portions 25 capable of receiving the liquid that has leaked from the liquid inlet portions 20 are preferably arranged at the lower side of the liquid inlet portions 20. The two positioning projections 36 are preferably provided so as to be aligned along the width direction X. In this case, each of the substrate connection portions 35, the liquid inlet portions 20, and the locking portions 31 is preferably arranged between the two positioning projections 36.

The mounting portion 14 may have guide portions 34 extending along the movement paths 32. At least a part of the second pressing portions 37 are preferably arranged along the guide portions 34. The guide portions 34 can be formed as, for example, linear recess portions or projections. When the plurality of different types of liquid accommodation bodies 40 are mounted on the mounting portion 14, the specific liquid accommodation bodies 40 that adapt to respective shapes can be allowed to be mounted by making arrangements and shapes of the guide portions 34 different from one another.

When the mounting portion 14 has bottom plates 38 forming the movement paths 32, preferably, grooves functioning as the guide portions 34 are provided in the bottom plates 38 and guide holes 38*a* in which the second pressing portions 37 are movable in a state of projecting therefrom are provided in the grooves. The mounting direction D1 corresponds to the lengthwise direction of the guide holes 38*a*. The length of each guide hole 38*a* in the lengthwise direction corresponds to a distance L2 (see FIG. 4) by which the liquid container 40 is movable in a state of receiving pressing force from the second pressing portion 37 on the movement path 32. This distance L2 is a pressing distance of each second pressing portion 37.

Each liquid container 40 has a bottom surface 41, a top surface 42, and side surfaces 43 and 44 as four outer surfaces extending in the depth direction Y, and a mounting surface 45 and a rear surface 46 intersecting with these four surfaces. The mounting surface 45 of the liquid container 40 is located at the terminating end side of the movement path 32 when the liquid container 40 is on the movement path 32. It is preferable that the liquid container 40 have, on the mounting surface 45, a liquid outlet portion 50 for leading out the liquid and pressing receiving portions 53 capable of being engaged with the first pressing portion 33.

Positioning holes 56 which are engaged with the positioning projections 36 in mounting on the mounting portion 14 are preferably provided in the mounting surface 45. A circuit substrate 55 which is electrically connected to the substrate connection portion 35 in mounting on the mounting portion 14 is preferably provided at the top surface 42 side. An engagement recess portion 51 capable of being engaged with the locking portion 31 in mounting on the mounting portion 14 is preferably provided in the bottom surface 41. The engagement recess portion 51 can be formed into, for example, a heart cam shape.

An engagement portion 47 capable of being engaged with the second pressing portion 37 is preferably provided on the bottom surface 41 of the liquid container 40. Engagement projections 48 capable of being engaged with the guide portions 34 may be provided on the bottom surface 41. In this case, the engagement projection 48 and the engagement portion 47 may be integrally formed (see FIG. 8 and FIG. 9 together). It is preferable that the engagement portion 47 be arranged at a position close to the center of the liquid container 40 relative to both ends thereof in the width direction X.

Figure 3:
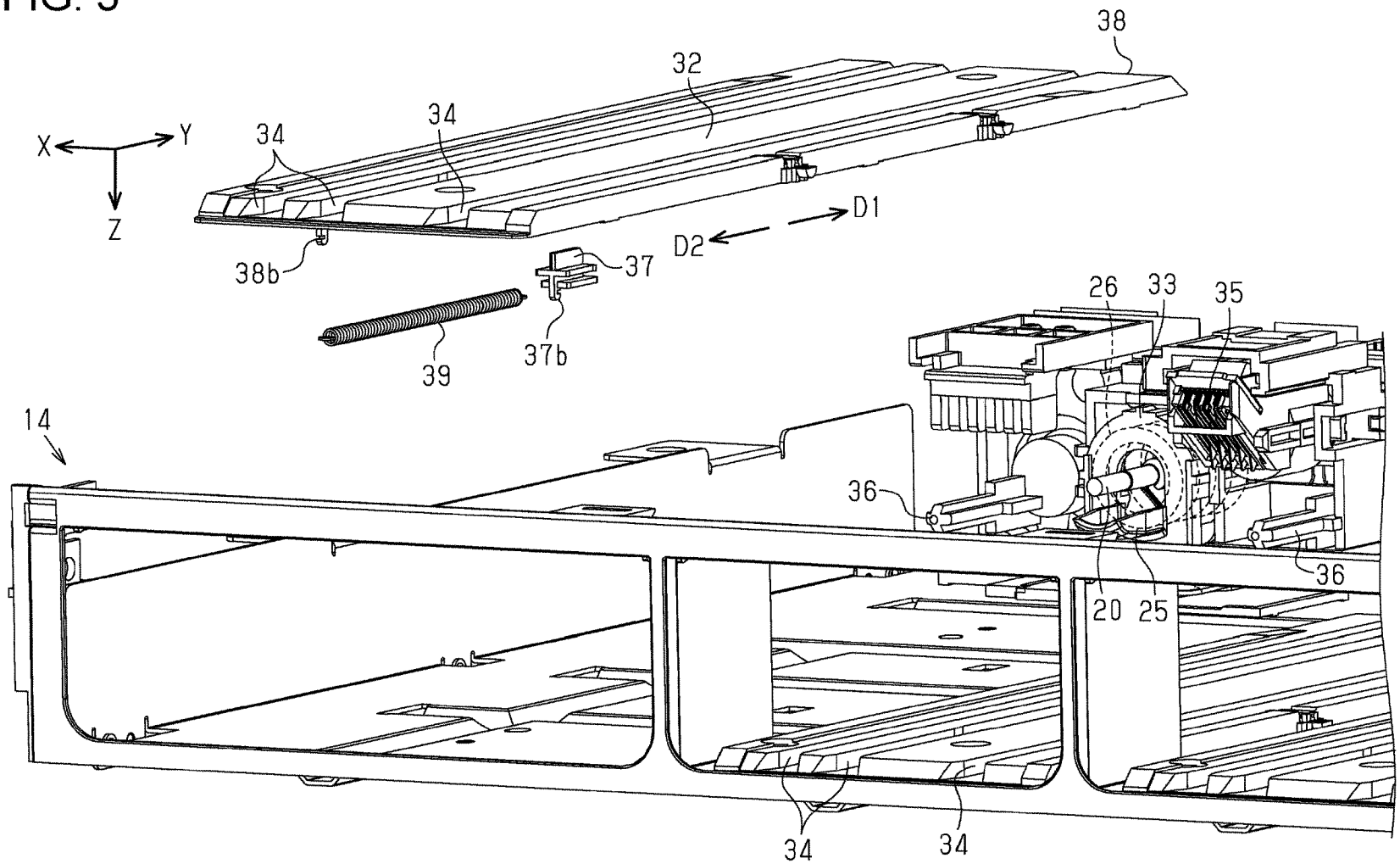
FIG. 3 is an exploded perspective view of the mounting portion in FIG. 2.

As illustrated in FIG. 3, the mounting portion 14 preferably includes second pressing members 39 applying pressing forces to the second pressing portions 37. The second pressing members 39 can be configured by, for example, coil springs, air springs, or plate springs. When the second pressing members 39 are the coil springs, preferably, first locking portions 38*b* are provided on the bottom plates 38, second locking portions 37*b* are provided on the second pressing portions 37, and both ends of the second pressing members 39 are hooked on the first locking portions 38*b* and the second locking portions 37*b*.

The mounting portion 14 preferably includes first pressing members 26 applying pressing forces to the first pressing portions 33. The first pressing members 26 can be configured by, for example, coil springs, air springs, or plate springs. When the first pressing members 26 are the coil springs, preferably, the first pressing portions 33 are formed into cylindrical shapes and the liquid inlet portions 20 are accommodated at the inner circumferential sides thereof. In this case, the first pressing portions 33 are preferably configured to be moved relatively to the liquid inlet portions 20 with extension and contraction of the first pressing members 26.

Figure 4:
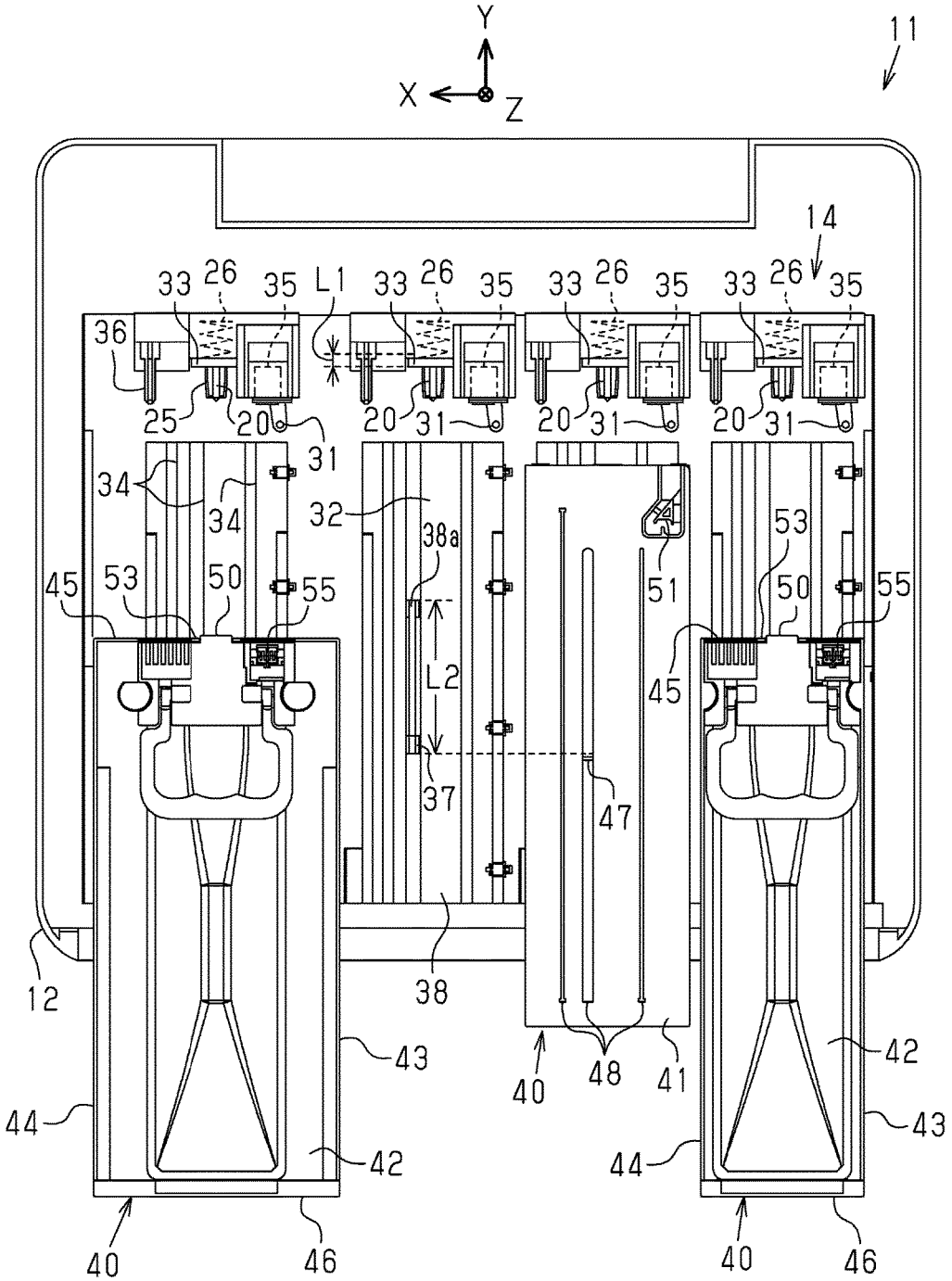
FIG. 4 is a plan view of the mounting portion and the liquid container included in the liquid ejecting apparatus in FIG. 1.

The liquid container 40 at the center among the three liquid accommodation bodies 40 aligned in the width direction X, which are illustrated in FIG. 4, schematically illustrates the configuration of the bottom surface 41.

As illustrated in FIG. 4, a distance by which each first pressing portion 33 is moved with the extension and contraction of the first pressing member 26 corresponds to a distance L1 by which the liquid container 40 is movable in a state of receiving the pressing force from the first pressing portion 33. When the distance L1 is a pressing distance of the first pressing portion 33, the pressing distance L2 of the second pressing portion 37 is longer than the pressing distance L1 of the first pressing portion 33.

When the liquid container 40 is put in the movement path 32 and is moved in the depth direction Y, the engagement portion 47 is engaged with the second pressing portion 37 on halfway of the movement path 32. Therefore, when the liquid container 40 is further moved to the back side on the movement path 32, the liquid container 40 receives the pressing force of the second pressing member 39. At this time, the liquid container 40 receives no pressing force from the first pressing portion 33.

When the liquid container 40 is close to the terminating end of the movement path 32, the positioning projections 36 are fitted into the positioning holes 56 and the positions of the liquid container 40 in the width direction X and the gravity direction Z are determined. When the liquid container 40 is further moved to the back side, the engagement recess portion 51 is engaged with the locking portion 31 and the liquid outlet portion 50 and the circuit substrate 55 are respectively connected to the liquid inlet portion 20 and the substrate connection portion 35.

When the liquid container 40 is locked by the locking portion 31, the second pressing portion 37 and the first pressing portion 33 press the liquid container 40. When the engagement recess portion 51 is caught by the locking portion 31, the liquid container 40 is held on the mounting portion 14 in a state of receiving the pressing forces from the first pressing portion 33 and the second pressing portion 37.

In the case in which each engagement recess portion 51 is formed into the heart cam shape, when the liquid container 40 locked by the locking portion 31 is pushed toward the mounting direction D1, the locking portion 31 is disengaged from the engagement recess portion 51. When the locking portion 31 is separated from the engagement recess portion 51, the liquid container 40 is moved in the takeout direction D2 toward the starting end of the movement path 32 with the pressing forces receiving from the first pressing portion 33 and the second pressing portion 37. When the pressing receiving portions 53 are separated from the first pressing portion 33 with the movement of the liquid container 40 in the takeout direction D2, the liquid container 40 no longer receives the pressing force of the first pressing member 26 and is moved in the takeout direction D2 with the pressing force of the second pressing member 39. In this manner, the second pressing portion 37 presses the liquid container 40 on the movement path 32 on which the liquid container 40 is away from the locking portion 31.

When the liquid container 40 is detached from the mounting portion 14, the liquid container 40 is preferably separated from the first pressing portion 33 after the liquid outlet portion 50 and the liquid inlet portion 20 are disconnected. With this configuration, both of the first pressing portion 33 and the second pressing portion 37 can press the liquid container 40 in the disconnection between the liquid outlet portion 50 and the liquid inlet portion 20, which needs a strong force. Provision of the liquid receiving portion 25 at the lower side of each liquid inlet portion 20 enables the liquid receiving portion 25 to receive the liquid which is leaking when the liquid outlet portion 50 and the liquid inlet portion 20 are disconnected.

When the liquid container 40 is detached from the mounting portion 14, the liquid container 40 is preferably separated from the first pressing portion 33 after the circuit substrate 55 and the substrate connection portion 35 are disconnected. With this configuration, both of the first pressing portion 33 and the second pressing portion 37 can press the liquid container 40 in the disconnection between the circuit substrate 55 and the substrate connection portion 35, which needs a strong force.

Figure 5:
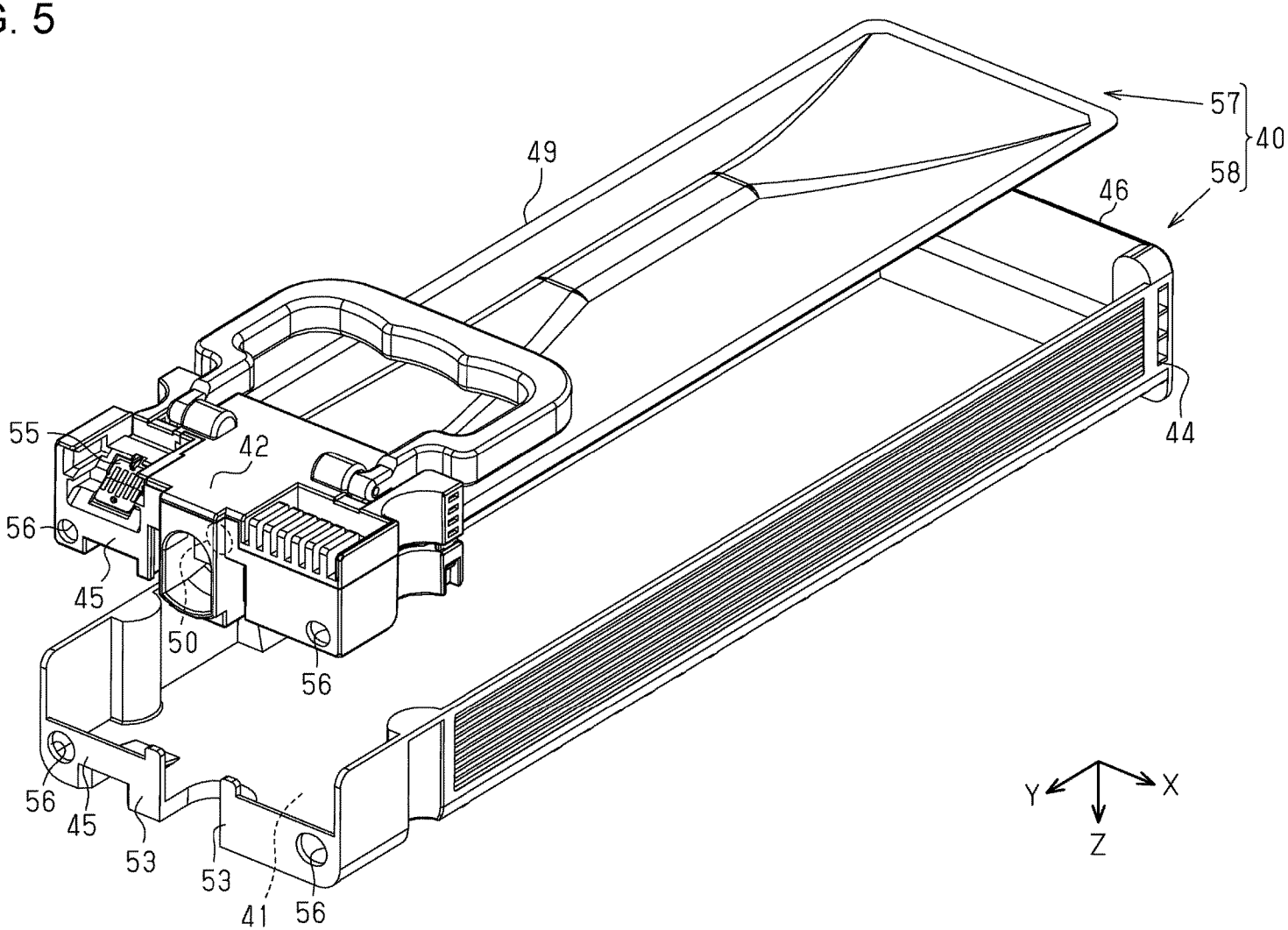
FIG. 5 is an exploded perspective view of the liquid container that is mounted on the liquid ejecting apparatus in FIG. 1.

As illustrated in FIG. 5, the liquid container 40 may have an container 57 with a bag 49 accommodating therein the liquid and a tray 58 on which the container 57 is mounted in a detachable manner. In this case, when the liquid is supplied, the container 57 is detached from the tray 58 and is replaced by a new container 57. Therefore, the tray 58 can be continuously used while replacing the container 57.

When the tray 58 configures the bottom surface 41, the side surfaces 43 and 44, and a lower portion of the mounting surface 45, the container 57 configures an upper portion of the mounting surface 45 and the top surface 42. In this case, the tray 58 has the pressing receiving portions 53 and the positioning holes 56 whereas the container 57 has the liquid outlet portion 50, the circuit substrate 55, and the positioning holes 56.

Figure 6:
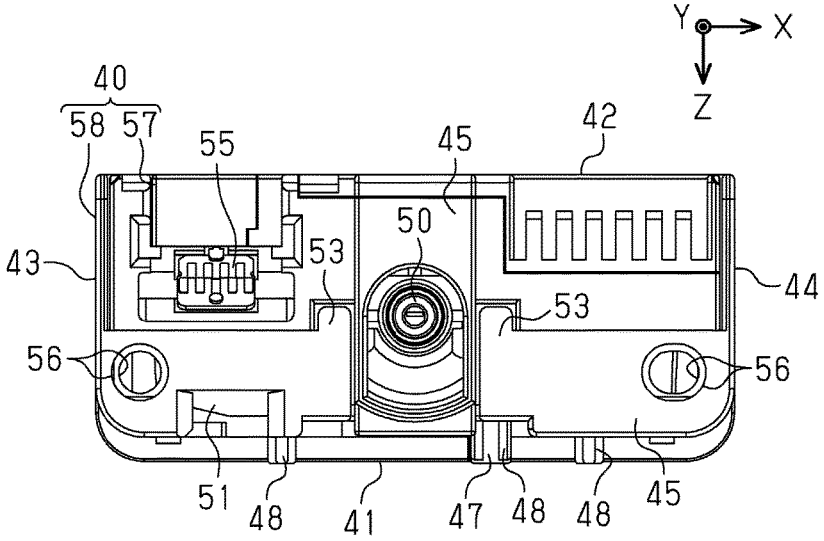
FIG. 6 is a front view of the liquid container in FIG. 5.
Figure 7:
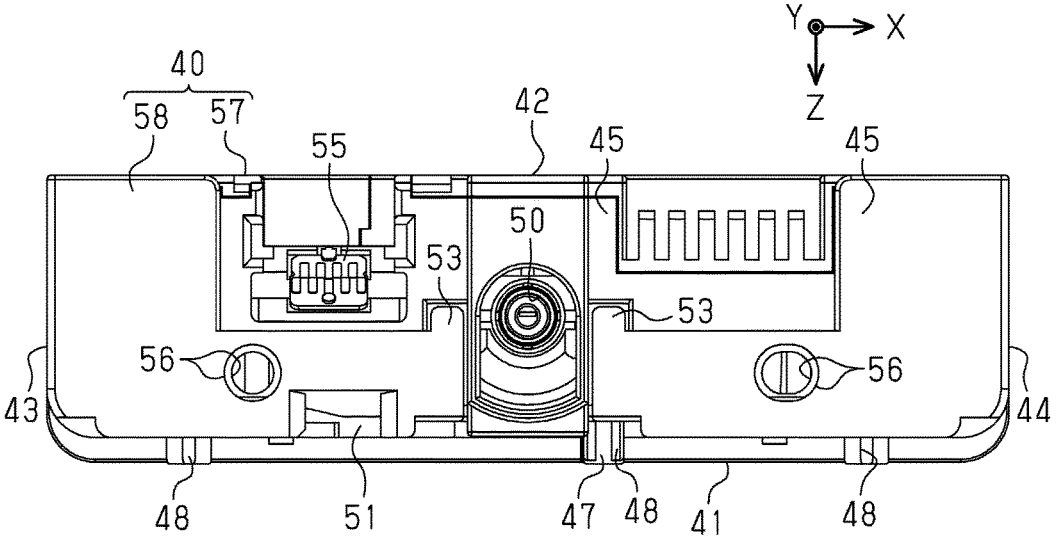
FIG. 7 is a front view of another liquid container having a different width from that of the liquid container in FIG. 6.

When a plurality of varieties of liquid accommodation bodies 40 having different widths as illustrated in FIG. 6 and FIG. 7 are provided, arrangements of the liquid outlet portions 50, the engagement recess portions 51, the pressing receiving portions 53, the circuit substrates 55, and the positioning holes 56 thereof are preferably made identical with the center in the width direction X as a reference.

The arrangements of the pressing receiving portions 53 and the engagement portions 47 relative to the liquid outlet portions 50 may be made identical among the liquid accommodation bodies 40 having different widths. For example, the two pressing receiving portions 53 can be arranged such that the liquid outlet portion 50 is interposed therebetween in the width direction X in each of front views illustrated in FIG. 6 and FIG. 7.

Figure 8:
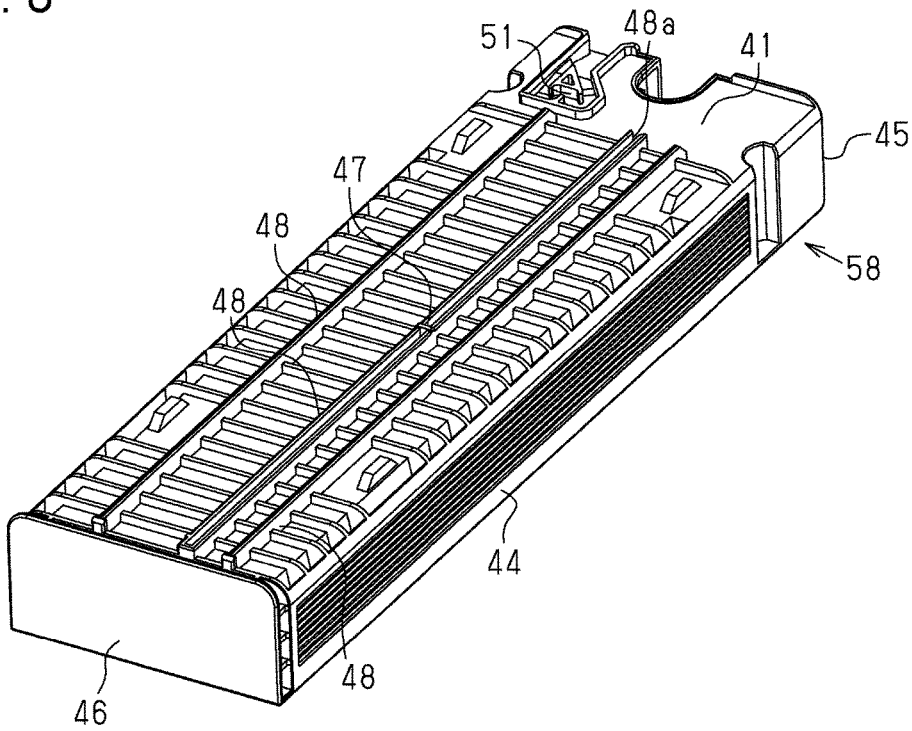
FIG. 8 is a perspective view illustrating a tray included in the liquid container in FIG. 6 when seen from the bottom side.
Figure 9:
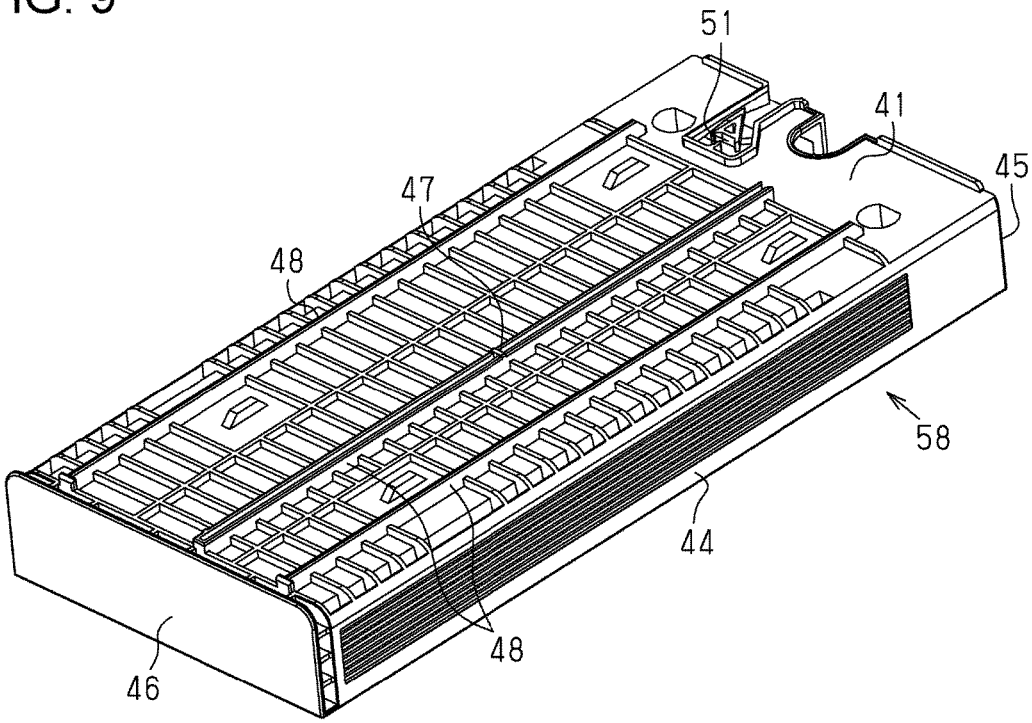
FIG. 9 is a perspective view illustrating a tray included in the liquid container in FIG. 7 when seen from the bottom side.

As illustrated in FIG. 8 and FIG. 9, the engagement recess portion 51 is preferably provided on the tray 58. In this case, each locking portion 31 illustrated in FIG. 2 is configured to lock the tray 58. Therefore, the tray 58 can be mounted on the mounting portion 14 (see FIG. 2) even in a state in which the container 57 is not mounted thereon. By contrast, the container 57 that is not mounted on the tray 58 cannot be mounted on the mounting portion 14 (see FIG. 2). When the container 57 that is not mounted on the tray 58 is put in the movement path 32 and presses the first pressing portion 33, the container 57 is pushed back while receiving the pressing force from the first pressing portion 33.

As illustrated in FIG. 5, FIG. 8, and FIG. 9, the pressing receiving portions 53, the engagement portion 47, and the engagement projections 48 are preferably provided in the tray 58. In this case, the first pressing portion 33 and the second pressing portion 37 illustrated in FIG. 2 are configured to press the tray 58. The shape of the bag 49 of the container 57 is changed depending on an accommodation amount of the liquid in some cases but the shape of the tray 58 is not changed. Therefore, provision of the pressing receiving portions 53 and the engagement portion 47 in the tray 58 enables the pressing force to act on the liquid container 40 reliably.

As illustrated in FIG. 8 and FIG. 9, the engagement portion 47 and the engagement projection 48 can be integrally formed by forming the groove 48*a* in the bottom of the engagement projection 48 and forming the engagement portion 47 so as to fill the groove 48*a*. In this case, when an end portion of the groove 48*a*, which is closer to the mounting surface 45, is opened, the second pressing portion 37 (see FIG. 2) can be made to enter the groove 48*a* from the opened end portion.

Next, actions and effects of the liquid ejecting apparatus 11 configured as described above will be described.

1. The liquid container 40 receives the pressing force of the second pressing portion 37 for a while after entering the movement path 32, and additionally receives the pressing force of the first pressing portion 33 when reaching the terminating end of the movement path 32 and being locked by the locking portion 31. Therefore, force necessary for a mounting operation of moving the liquid container 40 toward the locking portion 31 can be reduced in comparison with the case in which the liquid container 40 receives the pressing forces of the first pressing portion 33 and the second pressing portion 37 all the time through the movement. When the liquid container 40 is separated from the locking portion 31, the liquid container 40 is pushed out of the mounting portion 14 with the pressing force receiving from the second pressing portion 37 and is therefore easy to be detached. Accordingly, the liquid container 40 can be appropriately attached and detached.

2. The liquid container 40 receives the pressing force of the first pressing portion 33 on the pressing receiving portions 53 on the mounting surface 45 when making close to the locking portion 31. Therefore, when the liquid container 40 is separated from the locking portion 31, the liquid container 40 can be moved toward the starting end of the movement path 32 while receiving the pressing force of the first pressing portion 33 on the pressing receiving portions 53.

3. The engagement portion 47 is provided on the bottom surface 41 of the liquid container 40, which extends along the movement path 32, thereby increasing the distance L2 by which the second pressing portion 37 presses the liquid container 40. Therefore, a projecting amount of the liquid container 40 from the movement path 32 when the liquid container 40 is detached from the mounting portion 14 can be changed by adjusting the pressing distance L2 of the second pressing portion 37.

4. The liquid container 40 is moved along the movement path 32 in a state in which the engagement projections 48 are engaged with the guide portions 34. Therefore, the second pressing portion 37 can be reliably engaged with the liquid container 40 moving along the guide portions 34 by arranging the engagement portion 47 at a position along the engagement projection 48 and arranging the guide hole 38*a* at a position along the guide portion 34.

5. Each movement path 32 of the mounting portion 14 is longer in the mounting direction D1 because the lengthwise direction of the liquid container 40 is the mounting direction D1. When the second pressing portion 37 is arranged at a position along the movement path 32, the distance L2 by which the second pressing portion 37 presses the liquid container 40 can be adjusted in accordance with the length of the movement path 32.

The above-described embodiment may be changed as in the following variations. The configurations included in the above-described embodiment and configurations included in the following variations may be arbitrarily combined and the configurations included in the following variations may be arbitrarily combined with one another. In the following description, the same reference numerals denote components having the same functions as the above-described components and overlapped description thereof is omitted.

The first pressing portions 33 may be integrally configured with the first pressing members 26.

The second pressing portions 37 may be integrally configured with the second pressing members 39.

Each second pressing portion 37 may be engaged with the engagement portion 47 immediately after the mounting surface 45 of the liquid container 40 enters the movement path 32 or each second pressing portion 37 may be engaged with the engagement portion 47 after equal to or more than the half of the liquid container 40 enters the movement path 32.

Equal to or more than two first pressing portions 33 may be configured to be engaged with one liquid container 40.

Equal to or more than two second pressing portions 37 may be configured to be engaged with one liquid container 40. For example, when one liquid container 40 having a large width is mounted on the mounting portion 14, equal to or more than two second pressing portions 37 aligned along the width direction X may press the liquid container 40.

Each second pressing portion 37 may be configured to press the liquid container 40 by being engaged with the mounting surface 45, the side surface 43 or 44, or the top surface 42 of the liquid container 40.

When a space for increasing the pressing distance L1 of each first pressing portion 33 is present in the mounting portion 14, the pressing distance L1 of the first pressing portion 33 and the pressing distance L2 of the second pressing portion 37 may be the same as each other.

The liquid that the liquid ejecting head 21 ejects is not limited to ink and may be, for example, a fluid body formed by dispersing or mixing particles of a functional material in liquid. For example, the liquid ejecting head 21 may be configured to eject a fluid body in a form of a dispersion or a solution of a material such as an electrode material, a coloring material (pixel material) and the like. The material such as the electrode material, the coloring material and the like is used for manufacturing a liquid crystal display, an electroluminescence (EL) display, and a surface emitting display, and so on.

The medium 99 is not limited to the paper and may be a plastic film, a thin plate material, or a fabric that is used for a printing apparatus and the like. The medium 99 may be clothes having an arbitrary shape, such as a T-shirt, or a solid body having an arbitrary shape, such as a dish, a stationary and the like.

Hereinafter, technical ideas that are grasped from the above-described embodiment and variations, and action effects thereof will be described.

Idea 1

A liquid ejecting apparatus including:

a mounting portion on which a liquid container capable of accommodating liquid is mounted in a detachable manner; and a liquid ejecting head configured to eject the liquid which is supplied from the liquid container, wherein the mounting portion has a locking portion capable of locking the liquid container, a movement path extending toward the locking portion, and a first pressing portion and a second pressing portion capable of pressing the liquid container in a direction in which the liquid container is away from the locking portion, and the second pressing portion presses the liquid container on the movement path on which the liquid container is away from the locking portion, and the second pressing portion and the first pressing portion press the liquid container when the liquid container is locked by the locking portion.

With this configuration, the liquid container receives pressing force of the second pressing portion for a while after entering the movement path, and additionally receives pressing force of the first pressing portion when reaching a terminating end of the movement path and being locked by the locking portion. Therefore, force necessary for a mounting operation of moving the liquid container toward the locking portion can be reduced in comparison with the case in which the liquid container receives the pressing forces of the first pressing portion and the second pressing portion all the time through the movement. When the locking portion unlocks the liquid container, the liquid container is pushed out of the mounting portion with the pressing force of the second pressing portion and is therefore easy to be detached. Accordingly, the liquid container can be appropriately attached and detached.

Idea 2

The liquid ejecting apparatus according to Idea 1, wherein the liquid container has a pressing receiving portion capable of being engaged with the first pressing portion at an end of a terminating end side of the movement path when being located on the movement path.

With this configuration, the liquid container can receive the pressing force from the first pressing portion on the pressing receiving portion when making close to the locking portion.

Idea 3

The liquid ejecting apparatus according to Idea 1 or 2, wherein the liquid container has an outer surface extending along the movement path, and an engagement portion capable of being engaged with the second pressing portion is provided on the outer surface.

With this configuration, the engagement portion is provided on the surface of the liquid container, which extends along the movement path, thereby increasing a distance by which the second pressing portion presses the liquid container.

Idea 4

The liquid ejecting apparatus according to any one of Ideas 1 to 3, wherein the liquid container has an container accommodating the liquid and a tray on which the container is mounted in a detachable manner, and the first pressing portion and the second pressing portion are configured to press the liquid container by being engaged with the tray.

With this configuration, the tray can be permanently used while replacing the container.

Idea 5

The liquid ejecting apparatus according to any one of Ideas 1 to 4, wherein the liquid container has a liquid outlet portion for leading out the liquid at an end of a terminating end side of the movement path when being located on the movement path, the mounting portion has a liquid inlet portion capable of being connected to the liquid outlet portion, and when the liquid container is detached from the mounting portion, the liquid container is separated from the first pressing portion after the liquid outlet portion and the liquid inlet portion are disconnected.

With this configuration, both of the first pressing portion and the second pressing portion can press the liquid container in the disconnection between the liquid outlet portion and the liquid inlet portion, which needs a strong force.

Idea 6

The liquid ejecting apparatus according to any one of Ideas 1 to 5, wherein the liquid container has a circuit substrate, the mounting portion has a substrate connection portion which is electrically connected to the circuit substrate, and when the liquid container is detached from the mounting portion, the liquid container is separated from the first pressing portion after the circuit substrate and the substrate connection portion are disconnected.

With this configuration, both of the first pressing portion and the second pressing portion can press the liquid container in the disconnection between the circuit substrate and the substrate connection portion, which needs a strong force.

Idea 7

The liquid ejecting apparatus according to any one of Ideas 1 to 6, wherein the mounting portion has a guide portion extending along the movement path, and at least a part of the second pressing portion is arranged along the guide portion.

With this configuration, the second pressing portion can be reliably engaged with the liquid container moving along the guide portion.

Idea 8

The liquid ejecting apparatus according to any one of Ideas 1 to 7, wherein a distance by which the liquid container is movable in a state of receiving pressing force from the second pressing portion on the movement path is longer than a distance by which the liquid container is movable in a state of receiving pressing force from the first pressing portion on the movement path.

With this configuration, the distance by which the second pressing portion presses the liquid container can be adjusted in accordance with the length of the movement path.

The entire disclosure of Japanese Patent Application No. 2017-033038, filed Feb. 24, 2017, is expressly incorporated by reference herein.

What is claimed is:

1. A liquid ejecting apparatus comprising:

a mounting portion on which a liquid container capable of accommodating liquid is mounted in a detachable manner; and a liquid ejecting head configured to eject the liquid which is supplied from the liquid container, wherein the mounting portion has a locking portion capable of locking the liquid container, a movement path extending toward the locking portion, and a first pressing portion and a second pressing portion capable of pressing the liquid container in a direction in which the liquid container is away from the locking portion, wherein the second pressing portion presses the liquid container on the movement path on which the liquid container is away from the locking portion, and the second pressing portion and the first pressing portion press the liquid container when the liquid container is locked by the locking portion, and wherein the second pressing portion is located midway in the movement path and the first pressing portion is located closer to a terminating end in the movement path than the second pressing portion.

2. The liquid ejecting apparatus according to claim 1, wherein the first pressing portion is provided at the terminal end in the movement path and is engaged with a pressing receiving portion provided in the liquid container.

3. The liquid ejecting apparatus according to claim 1, wherein the liquid container has an outer surface extending along the movement path, and the second pressing portion is engaged with an engagement portion provided in the outer surface.

4. The liquid ejecting apparatus according to claim 1, wherein the liquid container has an container accommodating the liquid and a tray on which the container is mounted in a detachable manner, and the first pressing portion and the second pressing portion are configured to press the liquid container by being engaged with the tray.

5. The liquid ejecting apparatus according to claim 1, wherein the liquid container has a liquid outlet portion for leading out the liquid at an end of a terminating end side of the movement path when being located on the movement path, the mounting portion has a liquid inlet portion capable of being connected to the liquid outlet portion, and when the liquid container is detached from the mounting portion, the first pressing portion and the liquid container are separated from each other after the liquid outlet portion and the liquid inlet portion are disconnected.

6. The liquid ejecting apparatus according to claim 1, wherein the liquid container has a circuit substrate, the mounting portion has a substrate connection portion which is electrically connected to the circuit substrate, and when the liquid container is detached from the mounting portion, the first pressing portion and the liquid container are separated from each other after the circuit substrate and the substrate connection portion are disconnected.

7. The liquid ejecting apparatus according to claim 1, wherein the mounting portion has a guide portion extending along the movement path and guiding the liquid container, and at least a part of the second pressing portion is arranged along the guide portion.

8. The liquid ejecting apparatus according to claim 1, wherein a distance by which the liquid container is movable in a state of receiving pressing force from the second pressing portion on the movement path is longer than a distance by which the liquid container is movable in a state of receiving pressing force from the first pressing portion on the movement path.

9. The liquid ejecting apparatus according to claim 7, wherein the mounting portion includes a bottom plate forming the movement path, the bottom plate has a groove as the guide portion, and the second pressing portion moves along a guide provided in the groove.

10. The liquid ejecting apparatus according to claim 1, wherein the liquid container has a plurality of positioning holes on a mounting surface located at a tip when the liquid container is mounted, and the mounting portion includes a plurality of positioning projections engaging with the plurality of positioning holes.

* * * * *